US007004120B2

(12) United States Patent
Warren

(10) Patent No.: US 7,004,120 B2
(45) Date of Patent: Feb. 28, 2006

(54) OPPOSED PISTON ENGINE

(76) Inventor: James C. Warren, P.O. Box 10156, Alexandria, VA (US) 22310

( * ) Notice: Subject to any disclaimer, the term of this patent is extended or adjusted under 35 U.S.C. 154(b) by 0 days.

(21) Appl. No.: 10/841,526

(22) Filed: May 10, 2004

(65) Prior Publication Data

US 2004/0221823 A1 Nov. 11, 2004

Related U.S. Application Data

(60) Provisional application No. 60/468,961, filed on May 9, 2003.

(51) Int. Cl.
*F02B 57/00* (2006.01)

(52) U.S. Cl. ..... 123/43 R; 123/51 AA

(58) Field of Classification Search ..... 123/43 R, 123/43 A, 44 C, 51 R, 51 A, 51 AA, 51 B, 123/51 BA, 51 BC, 51 BD
See application file for complete search history.

(56) References Cited

U.S. PATENT DOCUMENTS

| | | | | |
|---|---|---|---|---|
| 936,074 A | | 10/1909 | Annable | 137/879 |
| 1,590,940 A | | 6/1926 | Hallett | 123/78 A |
| 1,736,639 A | | 11/1929 | Szydlowski | 123/51 BB |
| 1,899,217 A | | 2/1933 | Taylor et al. | 123/41.78 |
| 2,253,204 A | | 8/1941 | Di Lucci | 123/636 |
| 2,298,219 A | | 10/1942 | Major | 123/162 |
| 2,320,928 A | * | 6/1943 | Henson | 123/51 A |
| 2,412,952 A | | 12/1946 | Daub | 123/51 BB |
| 2,453,636 A | | 11/1948 | McKay | 290/1 A |
| 2,532,106 A | | 11/1950 | Korsgen | 123/51 R |
| 3,349,760 A | | 10/1967 | Horan | 123/162 |
| 3,397,681 A | | 8/1968 | Northrup | 123/90.11 |
| 3,702,057 A | | 11/1972 | Rabiger | 60/538 |
| 3,793,996 A | | 2/1974 | Scheerer | 123/205 |
| 4,011,839 A | | 3/1977 | Pfefferle | 123/1 R |
| 4,090,479 A | | 5/1978 | Kaye | 123/306 |
| 4,128,083 A | | 12/1978 | Bock | 123/46 R |
| 4,144,474 A | * | 3/1979 | Nishio et al. | 315/53 |
| 4,215,660 A | | 8/1980 | Finley | 123/78 E |
| 4,254,745 A | | 3/1981 | Noguchi et al. | 123/51 B |
| 4,300,512 A | | 11/1981 | Franz | 123/536 |
| 4,305,349 A | | 12/1981 | Zimmerly | 123/51 BB |
| 4,320,725 A | | 3/1982 | Rychlik et al. | 123/188.14 |
| 4,614,170 A | | 9/1986 | Pischinger et al. | 123/90.11 |
| 4,782,798 A | | 11/1988 | Jones | 123/90.11 |
| 4,841,923 A | | 6/1989 | Büchl | 123/90.11 |
| 4,846,120 A | | 7/1989 | Büchl | 123/90.11 |
| 4,938,179 A | | 7/1990 | Kawamura | 123/90.11 |
| 5,143,038 A | | 9/1992 | Dahlgren et al. | 123/403 |
| 5,590,629 A | | 1/1997 | Codina et al. | 123/310 |
| 5,623,894 A | | 4/1997 | Clarke | 123/50 R |
| 5,638,780 A | | 6/1997 | Duvinage et al. | 123/65 VA |
| 5,674,053 A | | 10/1997 | Paul et al. | 417/228 |
| 5,778,834 A | | 7/1998 | Piccinini | 123/55.2 |
| 5,799,628 A | | 9/1998 | Lacerda | 123/52.3 |
| 5,915,349 A | | 6/1999 | Biemelt et al. | 123/162 |

(Continued)

FOREIGN PATENT DOCUMENTS

DE 32 07 349 A1 9/1983

(Continued)

*Primary Examiner*—Noah P. Kamen
(74) *Attorney, Agent, or Firm*—Richard C. Litman

(57) ABSTRACT

A four-stroke opposed piston engine includes a rotating cylinder with a circumference and an aperture defined through the circumference, first and second opposing pistons, optional first and second opposing cylindrical spacers, first and second opposing piston caps, a spark rod that bisects the cylinder with insulating elements, and a pair of opposing gears.

16 Claims, 12 Drawing Sheets

U.S. PATENT DOCUMENTS

| | | | | |
|---|---|---|---|---|
| 6,170,443 | B1 | 1/2001 | Hofbauer | 123/51 B |
| 6,213,147 | B1 | 4/2001 | Gramann et al. | 137/554 |
| 6,453,862 | B1 | 9/2002 | Holzmann | 123/162 |
| 6,532,916 | B1 | 9/2002 | Holzmann | 123/46 E |
| 2001/0029911 | A1 | 10/2001 | Yang et al. | 123/46 E |
| 2002/0117132 | A1 | 8/2002 | D'Alpaos et al. | 123/90.11 |
| 2002/0139323 | A1 | 10/2002 | Kerrebrock | 123/46 E |
| 2002/0157622 | A1 | 10/2002 | Meintachel et al. | 123/90.11 |
| 2003/0010307 | A1 | 1/2003 | Truglio | 123/162 |
| 2003/0019445 | A1 | 1/2003 | Muraji | 123/90.11 |
| 2003/0024502 | A1 | 2/2003 | Kreuter | 123/337 |
| 2003/0034470 | A1 | 2/2003 | Pedroni | 251/129.04 |
| 2003/0044293 | A1 | 3/2003 | Gray, Jr. | 417/364 |

FOREIGN PATENT DOCUMENTS

| | | | |
|---|---|---|---|
| DE | 39 05 574 | A1 | 6/1990 |
| DE | 43 00 666 | A1 | 4/1995 |
| DE | 43 35 515 | A1 | 4/1995 |
| DE | 198 57 734 | A1 | 6/2000 |
| DE | 100 26 458 | A1 | 12/2001 |
| EP | 0 139 566 | | 5/1985 |
| GB | 2 030 213 | A | 4/1980 |
| JP | 2-252909 | | 10/1990 |
| JP | 2-308910 | | 12/1990 |
| JP | 4-287814 | | 10/1992 |

* cited by examiner

OPPOSED PISTON ENGINE

CROSS-REFERENCE TO RELATED APPLICATION

This application claims the benefit of U.S. Provisional Patent Application Ser. No. 60/468,961, filed May 9, 2003, which is incorporated herein by reference.

BACKGROUND OF THE INVENTION

1. Field of the Invention

The present invention generally relates to an opposed piston engine and, more particularly, to an opposed piston engine which increases the thermal, mechanical, and volumetric efficiencies that make up the overall efficiency of an engine.

2. Description of the Related Art

Modern internal combustion engines have changed little since the 1910. They generally consist of an Otto cycle internal combustion engine fed by poppet valves, the valves being camshaft actuated. Advances in engine management and materials have increased efficiency to the current levels. The current levels, expressed as a percentage of the available energy contained in a gallon of gasoline, which is not lost through mechanical, thermal, or volumetric inefficiency, is about 25 to 35 percent.

It has long been understood that an opposed piston engine delivers superior performance for its size. Two pistons, sharing a single cylinder, cycling together, produce tremendous power. The problem has been how to valve them. Because the pistons meet at the center of the cylinder, there is no place for a conventional valve system. The current practice is to rely on the use of scavenger valves. This is somewhat effective but cannot meet today's stringent environmental standards, relegating the opposed piston engine to naval ships and power plants.

Therefore, a need exists for an effective and efficient opposed piston engine which increases the thermal, mechanical, and volumetric efficiencies that make up the overall efficiency of an engine. The related art is represented by the following references of interest.

Internal combustion engines, and in particular, opposed piston engines have been the subject of several prior patents. U.S. Pat. No. 2,298,219, issued Oct. 6, 1942 to Edgar M. Major, describes an ignition system for internal combustion engines including an electrode pin at the top of the combustion chamber and a firing pin on the piston. U.S. Pat. No. 3,397,681, issued Aug. 20, 1968 to James W. Northrup, describes electrical operation of valves for internal combustion engines including an electromagnet. U.S. Pat. No. 5,623,894, issued Apr. 29, 1997 to John M. Clarke, describes a dual compression and dual expansion engine. The Clarke engine is an opposed piston engine that utilizes a cylindrical sleeve valve.

German Patent Application Publication No. DE 198 57 734 A1, published Jun. 29, 2000, describes an opposed piston engine with a Hall sensor arrangement for changing an induction valve between two and four stroke modes, a holding magnet for controlling a valve during compression, and control electronics. U.S. Pat. No. 6,318,309 B1, issued Nov. 20, 2001 to Robert W. Burrahm et al., describes an opposed piston engine with reserve power capacity including a conventional electronic engine control unit.

U.S. Patent Application Publication No. 2003/0010307 A1, published Jan. 16, 2003 for Rosario Truglio, describes a piston with an integrated spark electrode. The spark electrode in Truglio creates a spark when it is close to a power plug in the wall of the combustion chamber. U.S. Patent Application Publication No. 2003/0024502 A1, published Feb. 6, 2003 for Peter Kreuter, describes a supplemental control valve device for supplemental flow control of an internal combustion engine intake channel, which includes magnets.

Other art related to internal combustion and opposed piston engines includes: U.S. Patent Application Publication No. 2001/0029911 A1, published Oct. 18, 2001 for Wei Yang et al. (microcombustion engine/generator); and U.S. Patent Application Publication No. 2002/0117132 A1, printed Aug. 29, 2002 to Egidio D'Alpaos et al. (method of estimating the effect of the parasitic currents in an electromagnetic actuator for the control of an engine valve).

More art related to internal combustion and opposed piston engines includes: U.S. Patent Application Publication No. 2002/0139323 A1, published Oct. 3, 2002 to Jack L. Kerrebrock (opposed piston linearly oscillating power unit); and U.S. Pat. No. Application Publication No. 2002/0157622 A1, published Oct. 31, 2002 for Meintschel et al. (device for actuating a gas exchange valve).

Other art related to internal combustion and opposed piston engines includes: U.S. Patent Application Publication No. 2003/0019445 A1, printed Jan. 30, 2003 for Tetsuo Muraji (internal combustion engine with exhaust gas control device) U.S. Patent Application Publication No. 2003/0034470 A1, published Feb. 20, 2003 for Gianni Padroni (control method for an electromagnetic actuator for the control of a valve of an engine from a rest condition); and U.S. Patent Application Publication No. 2003/0044293 A1, published Mar. 6, 2003 for Charles L. Gray, Jr. (fully-controlled, free-piston engine).

More art related to internal combustion and opposed piston engines includes: U.S. Pat. No. 936,074, issued Oct. 5, 1909 to Warren W. Annable (electrically operated valve); U.S. Pat. No. 1,590,940, issued Jun. 29, 1926 to Fred N. Hallett (gas engine); U.S. Pat. No. 1,736,639, issued Nov. 19, 1929 to Josef Szydlowski (driving mechanism for internal combustion engines).

Other art related to internal combustion and opposed piston engines includes: U.S. Pat. No. 1,899,217, issued Feb. 28, 1933 to Edward S. Taylor et al. (internal combustion engine); U.S. Pat. No. 2,253,204, issued Aug. 19, 1941 to Anthony J. Di Lucci (internal combustion engine ignition system); U.S. Pat. No. 2,412,952, issued Dec. 24, 1946 to Rudolph Daub (internal combustion engine).

More art related to internal combustion and opposed piston engines includes: U.S. Pat. No. 2,453,636, issued Nov. 9, 1948 to Maurice P. McKay (low tension ignition system for miniature two-cycle gas engines); U.S. Pat. No. 2,532,106, issued Nov. 28, 1950 to Theodore Y. Korsgren (multiple opposed piston engine); U.S. Pat. No. 3,349,760, issued Oct. 31, 1967 to John J. Horan (engine-ignition systems and components)

Other art related to internal combustion and opposed piston engines includes: U.S. Pat. No. 3,702,057, issued Nov. 7, 1972 to Wolfgang Rabiger (process for control and regulation of double piston-driven engine with hydrostatic motion transducers); U.S. Pat. No. 3,793,996, issued Feb. 26, 1974 to Arthur M. Scheerer (rotary combustion engine with improved firing system); U.S. Pat. No. 4,011,839, issued Mar. 15, 1977 to William C. Pfefferle (method and apparatus for promoting combustion in an internal combustion engine using a catalyst).

More art related to internal combustion and opposed piston engines includes: U.S. Pat. No. 4,090,479, issued May 23, 1978 to Frank Kaye (I.C. engine having improved air or air-fuel induction system); U.S. Pat. No. 4,092,957, issued Jun. 6, 1978 to Donald Tryhorn (compression ignition internal combustion engine); U.S. Pat. No. 4,128,083, issued Dec. 5, 1978 to Rudolf Bock (gas cushioned free piston type engine).

Other art related to internal combustion and opposed piston engines includes: U.S. Pat. No. 4,185,596, issued January 29, 1980 to Masaaki Noguchi et al. (two-stroke cycle gasoline engine); U.S. Pat. No. 4,215,660, issued Aug. 5, 1980 to Donald G. Finley (internal combustion engine); and U.S. Pat. No. 4,254,745, issued Mar. 10, 1981 to Masaaki Noguchi et al. (two-stroke cycle gasoline engine).

More art related to internal combustion and opposed piston engines includes: U.S. Pat. No. 4,300,512, issued Nov. 17, 1981 to Dennis L. Franz (MHD engine); U.S. Pat. No. 4,305,349, issued Dec. 15, 1981 to Harold L. Zimmerly (internal combustion engine); and U.S. Pat. No. 4,320,725, issued Mar. 23, 1982 to Frank J. Rychlik, deceased et al. (puffing swirler).

Other art related to internal combustion and opposed piston engines includes: U.S. Pat. No. 4,614,170, issued Sep. 30, 1986 to Franz Pischinger et al. (method of starting a valve regulating apparatus for displacement-type machines); U.S. Pat. No. 4,782,798, issued Nov. 8, 1988 to Horace L. Jones (cybernetic engine); and U.S. Pat. No. 4,841,923, issued Jun. 27, 1989 to Josef Buchl (method for operating I.C. engine inlet valves).

More art related to internal combustion and opposed piston engines includes: U.S. Pat. No. 4,846,120, issued Jul. 11, 1989 to Josef Buchl (method of operating an internal combustion engine); U.S. Pat. No. 4,938,179, issued Jul. 3, 1990 to Hideo Kawamura (valve control system for internal combustion engine); and U.S. Pat. No. 5,143,038, issued Sep. 1, 1992 to Jan Dahlgren et al. (internal combustion engine with delayed charging).

Other art related to internal combustion and opposed piston engines includes: U.S. Pat. No. 5,161,494, issued Nov. 10, 1992 to John N. Brown, Jr. (electromagnetic valve actuator); U.S. Pat. No. 5,590,629, issued Jan. 7, 1997 to George Codina et al. (spark ignition system of an internal combustion engine); and U.S. Pat. No. 5,638,780, issued Jun. 17, 1997 to Frank Duvinage et al. (inlet system for a two cycle internal combustion engine).

More art related to internal combustion and opposed piston engines includes: U.S. Pat. No. 5,674,053, issued Oct. 7, 1997 to Marius A. Paul et al. (high pressure compressor with controlled cooling during the compression phase); U.S. Pat. No. 5,778,834, issued Jul. 14, 1998 to Giuseppe R. Piccinini (opposed reciprocating piston internal combustion engine); and U.S. Pat. No. 5,799,628, issued Sep. 1, 1998 to Carlos B. Lacerda (internal combustion engine with rail spark plugs and rail fuel injectors).

Other art related to internal combustion and opposed piston engines includes: U.S. Pat. No. 5,915,349, issued Jun. 29, 1999 to Andreas Biemelt et al. (gasoline internal combustion engine); U.S. Pat. No. 6,170,443 B1, issued Jan. 9, 2001 to Peter Hofbauer (internal combustion engine with a single crankshaft and having opposed cylinders with opposed pistons); and U.S. Pat. No. 6,213,147 B1, issued Apr. 10, 2001 to Matthias Gramann et al. (magnetic screening of an actuator for electromagnetically controlling a valve).

More art related to internal combustion and opposed piston engines includes: U.S. Pat. No. 6,453,862 B1, issued Sep. 24, 2002 to Josef Holzmann (ignition device for piston-type internal combustion engine); and U.S. Pat. No. 6,532,916 B2, issued Mar. 18, 2003 to Jack L. Kerrebrock (opposed piston linearly oscillating power unit).

Other art related to internal combustion and opposed piston engines includes: Great Britain Patent Application Publication No. GB 2 030 213 A, published Apr. 2, 1980 (opposed piston engine); European Patent Application Publication No. EP 0 139 566, published May 2, 1985 (electro-hydraulic unit for the control of the valves of an internal combustion engine); and German Patent Application Publication No. DE 32 07 349 A1, published Sep. 15, 1983 (opposed-piston internal combustion engine).

More art related to internal combustion and opposed piston engines includes: German Patent Application Publication No. DE 39 05 574 A1, published Jun. 28, 1990 (engine with a cylinder and two pistons displaceable therein); Japanese Patent Application Publication No. 2-252909, published Oct. 11, 1990 (opposed piston rotary type sleeve valve internal combustion engine); and Japanese Patent Application Publication No. 2-308910, published Dec. 21, 1990 (electromagnetic force operated valve drive device).

Other art related to internal combustion and opposed piston engines includes: Japanese Patent Application Publication No. 4-287814, published Oct. 13, 1992 (valve system of engine); and German Patent Application Publication No. DE 43 00 666 A1, published Jul. 22, 1993 (actuator for IC engine valve—has electromagnets with dish shaped ring poles with wedges forming cylindrical chamber for armature).

More art related to internal combustion and opposed piston engines includes: German Patent Application Publication No. DE 43 35 515 A1, published Apr. 20, 1995 (opposed-piston two-stroke internal combustion engine with spark ignition, direct fuel injection into the cylinder and stratified charge); and German Patent Application Publication No. DE 100 26 458 A1, published Dec. 13, 2001 (low-emission opposed piston 2-stroke engine with undersides of working pistons and automatic valves acting as scavenging pumps and connected to scavenging medium container).

None of the above inventions and patents, taken either singly or in combination, is seen to describe the instant invention as claimed. Thus an opposed piston engine solving the aforementioned problems is desired.

SUMMARY OF THE INVENTION

The present invention is an opposed piston engine. The opposed piston engine may be a four cycle engine and includes a rotating cylinder with a circumference and an aperture defined through the circumference, first and second opposing pistons, first and second opposing cylindrical spacers, first and second opposing piston caps, a spark rod that bisects the cylinder with insulating elements, and a pair of opposing gears.

The opposed piston engine may also have a first piston, a second piston opposed to the first piston, a valve, an intake, and an exhaust. An important feature of the present invention is the location of the valve, and the location of the intake and exhaust with respect to the valve. The valve is located between the first and second pistons, the first and second pistons reciprocate along a first centerline, and the first centerline is perpendicular to a second centerline. The valve may be centered between the first and second pistons, and may be located at the intersection of the first and second centerlines. The intake and exhaust may be located along the second centerline, and may be adjacent to the valve. The opposed piston engine of the present invention achieves an improvement in fuel efficiency of less than or equal to 30% compared to conventional engines.

Also, unlike prior opposed piston engines, the engine may not require a scavenging valve. Further, an igniter may pass through the valve in a direction perpendicular to the first centerline. The valve may be opened and closed using electromagnetic, gear or camshaft actuation. The engine may be a four-stroke engine.

Accordingly, it is a principal aspect of the invention to provide a four-stroke opposed piston engine.

It is another aspect of the invention to provide an opposed piston engine that does not require a scavenging valve.

Still further another aspect of the invention is to provide an opposed piston engine utilizing an essentially centrally located valve, which is opened and closed using electromagnetic, gear driven or camshaft actuation.

It is an aspect of the invention to provide improved elements and arrangements thereof in an opposed piston engine for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
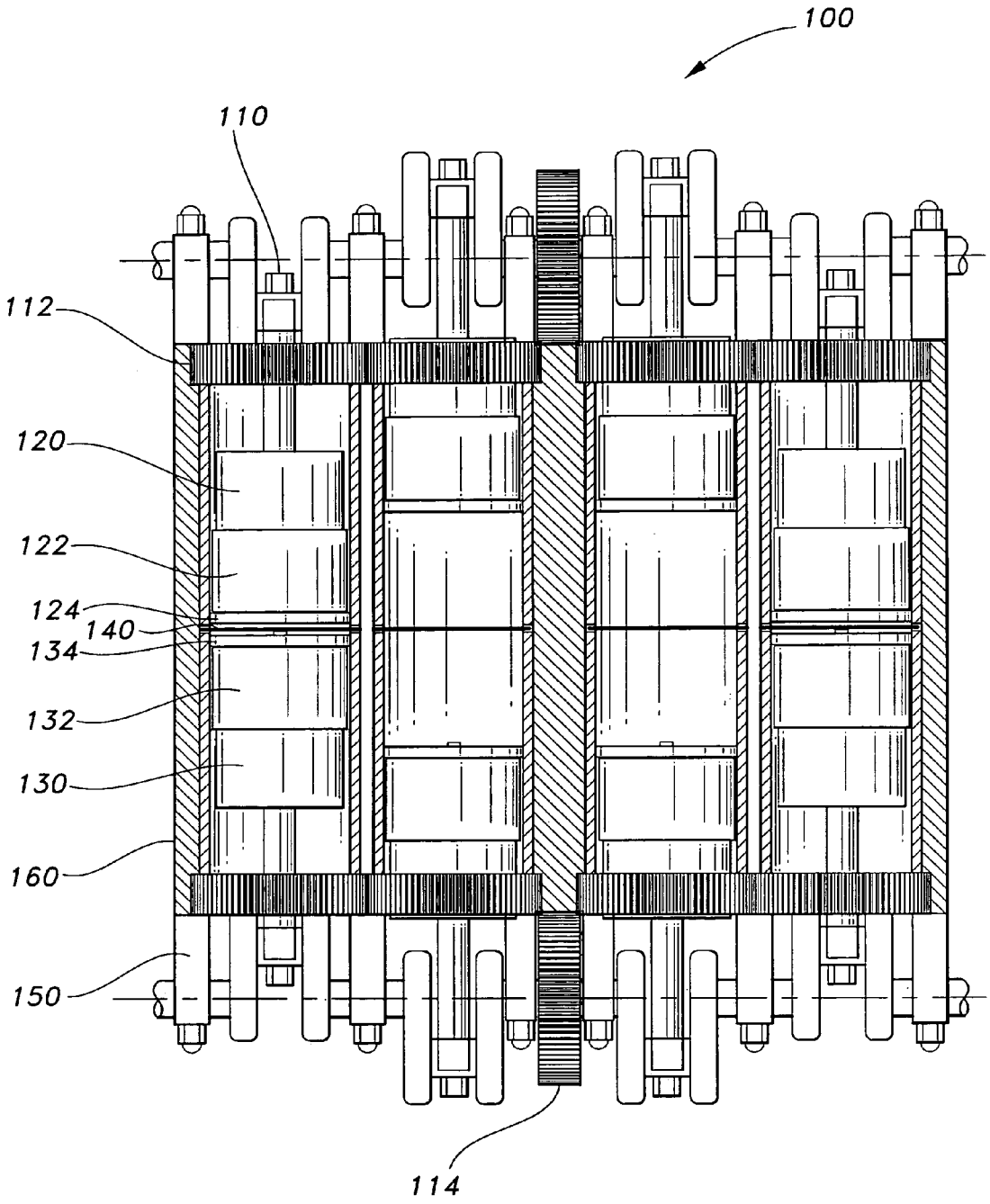
FIG. 1 is a cross sectional view of an example of an opposed piston engine according to the present invention.

The present invention is an opposed piston engine. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Figure 2:
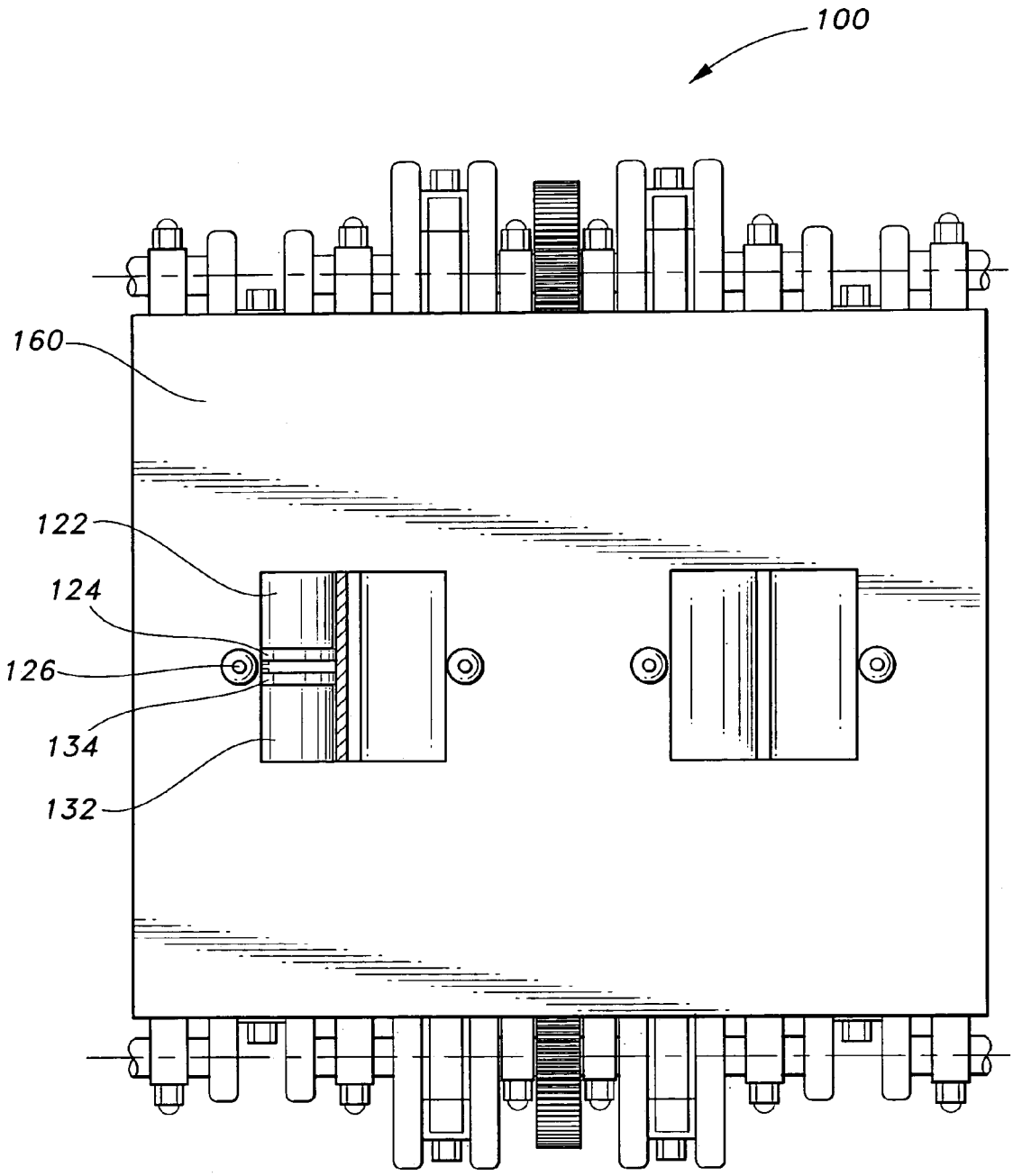
FIG. 2 is a top view of the opposed piston engine shown in FIG. 1.

Referring to the drawings, preferred examples of opposed piston engines according to the present invention are shown in FIGS. 1–2. The opposed piston engine 100 is a four-cycle engine and while it is illustrated with four cylinders configured for rotating, any number of rotating cylinders may be utilized depending on the amount of power desired to be produced by the engine 100. Each cylinder of the engine is associated with a pair of connecting rods 110, a pair of opposing gears 112, opposing first and second pistons 120 and 130 that are each interconnected with a connecting rod 112, optional first and second opposing cylindrical spacers 122 and 132, first and second opposing piston caps 124 and 134, a spark rod 140, and a pair of bearing caps 150.

Each gear 112 is attached to each end of a cylinder and is driven by a gear 114 sharing the same axis as the associated crankshaft (not shown). Each associated crankshaft is configured to provide predetermined stroke lengths to the first and second pistons 120 and 130. The first and second pistons 120 and 130 may be of a relatively standard design, and have predetermined lengths and predetermined diameters.

Optional first and second cylindrical spacers 122 and 132 are affixed to the face of the associated pistons 120 and 132. The optional spacers 122 and 132 are not necessary but may be utilized to provide correct piston lengths. The piston lengths are geometrically determined n accordance with the stroke length and the aperture of the rotating cylinders.

First and second piston caps 124 and 134 of associated optional cylindrical spacers 122 and 132 rotate along with the associated cylinder. Each piston cap 124 and 134 is preferably a sandwich of two sheets of carbon fiber with a ceramic center. Separate from the actual pistons 120 and 130, the piston caps 124 and 134 rotate along with the cylinder. The piston caps 124 and 134 rotate on a shaft affixed to the actual associated piston 120 or 130. The shaft has a lip which fits into the aperture in the cylinder wall and has a thickness which matches the cylinders thickness. The piston caps 124 and 134 which are exposed to the combustion event are slightly concave in form so that when the two piston caps 124 and 134 meet in the center of the cylinder they form a somewhat spherical combustion chamber. Only the ceramic core of the piston caps 124 and 134 actually come into contact with the cylinder wall.

A bearing cap 150 is mounted on each end of each rotating cylinder. If no spacers are utilized dry race bearings are positioned between the top of the piston and the piston caps associated with the piston. If spacers are utilized dry race bearings are positioned between the top of the spacer and the cap associated with the piston. The dry race bearings are preferably made of ceramic material to provide an essentially friction free rotation. The piston should have a length from the fire ring to the cap of a suitable length in order to keep the rings out of the aperture. The optional spacers 122 and 132, and piston caps 124 and 134 each have a diameter roughly equal to the interior of the associated cylinder, and are preferably made of carbon fiber and/or ceramic to eliminate thermal inefficiencies which plague current engine designs, resulting in even more substantial performance gains.

The gears 112 are configured to rotate each associated cylinder at a speed of one half crank speed, and each cylinder has a predetermined length. As more fully described below, each rotating cylinder has an aperture defined therein which precludes any valving needs and/or requirements (see 410 in FIG. 5). Each aperture that is equal to twice the stroke length plus the thickness of the piston caps 124 and 134, and has a size between 0° and 90° of the full 360° circumference of the associated cylinder, preferably between 30° and 70°, and even more preferably about 60°, although any suitable size may be used. A spark plug 126 is positioned in the block for each cylinder. Each cylinder has a spark rod 140 which passes through the center of the cylinder and rotates with the cylinder. The spark rod 140 is a thin conductive sheet with a small perforation in the center. When the piston of a cylinder is at top dead center on the compression stroke, the spark rod 140 becomes aligned with the spark plug. A spark from the spark plug 126 then jumps or arcs from the plug to the spark rod 140 to a grounding element in one of the piston caps 124 and 134. The grounding element allows the associated spark to ignite the air fuel mixture at the exact center of the combustion chamber, promoting a very efficient burn.

An external view of the opposed piston engine 100 is shown in FIG. 2, illustrating the block 160 itself with the intake plenums exposed. In FIGS. 1 and 2, the first and second pistons 122 and 134 in the far left cylinder 150 are at the apex of their stroke, at which they would not be exposed during the actual operation of the engine 100. The exposed element of each spark plug is shown as 126.

Figure 3:
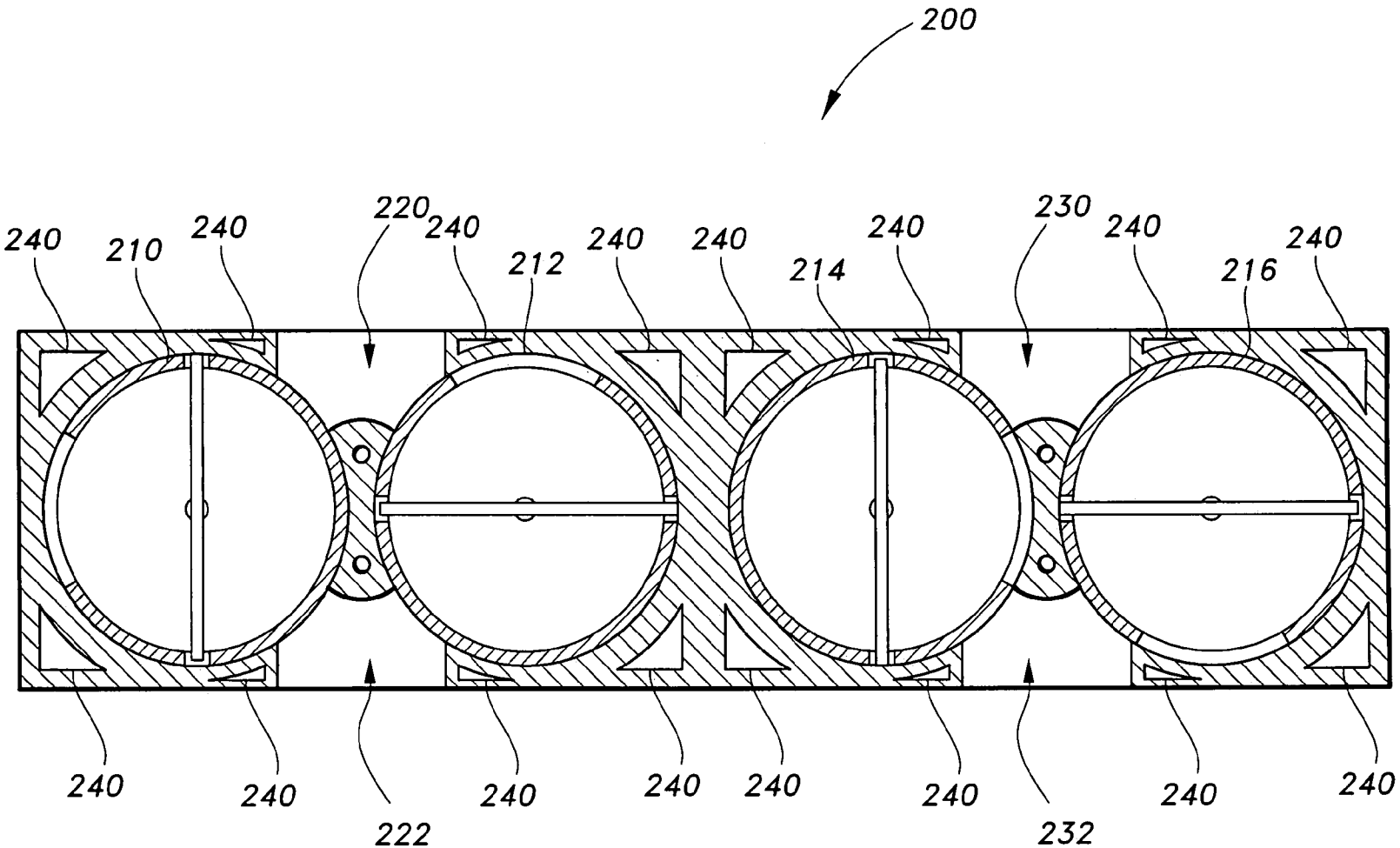
FIG. 3 is a cross sectional view of an example of a block of an opposed piston engine according to the present invention.

A cross section of an engine block 200 showing two intake plenums 220 and 230, and two associated exhaust plenums 222 and 232 is illustrated in FIG. 3. Cooling channels 240 are also illustrated. Two cylinders 210 and 212 share a common intake and exhaust runner. Each runner, after branching off from the plenum, is preferably about sixty degrees of the outside diameter of the cylinder and is preferably equal to the length of the stroke of both pistons combined. The rotating cylinders 210, 212, 214, and 216 are illustrated at various stages of the combustion cycle, e.g., induction, compression, power (or ignition), and exhaust.

At the beginning of the combustion cycle, exhaust gasses have been purged and the pistons 120 and 130 and associated piston caps 124 and 134 are at top dead center. As they begin to draw apart, the aperture of the cylinder begins to align with its intake runner. When the piston caps 124 and 134 are halfway to bottom dead center, the aperture is completely open. By the time the pistons 120 and 130 are at bottom dead center the alignment is ended, and the compression stroke is commencing. As the pistons 120 and 130 are forced to the center of the cylinder, the spark rod 140 is aligned with the spark plug 126. The ignition charge now arcs from the truncated spark plug 126 to the conductive spark rod 140. The grounding element on one of the piston caps 124 or 134 is not at an optimal position and charge arcs again, igniting the air fuel mixture. Now the power strike has begun. The pistons 120 and 130 move away from each other as the force of the expanding gasses dictate. When the pistons 120 and 130 have reached bottom dead center, the aperture of the cylinder has begun to align with the exhaust runner. As the pistons 120 and 130 begin to move back towards top dead center, exhaust gasses are expelled. When the pistons 120 and 130 are halfway to top dead center, the cylinder aperture is completely aligned. As the piston caps 124 and 134 reaches top dead center, the aperture closes, allowing a new cycle to begin.

Figure 4:
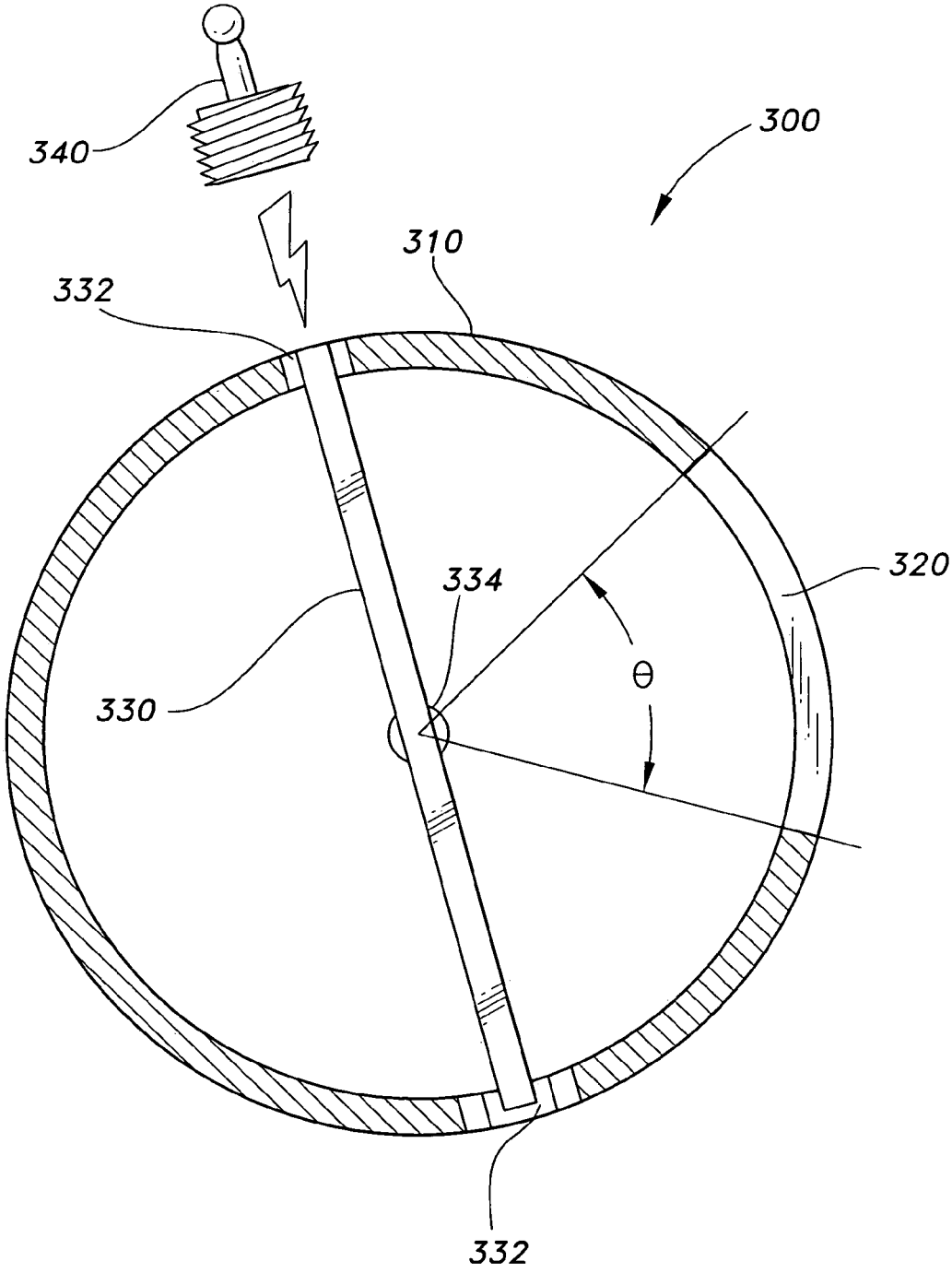
FIG. 4 is a cross sectional view of a rotating cylinder in an opposed piton engine according to the present invention.
Figure 5:
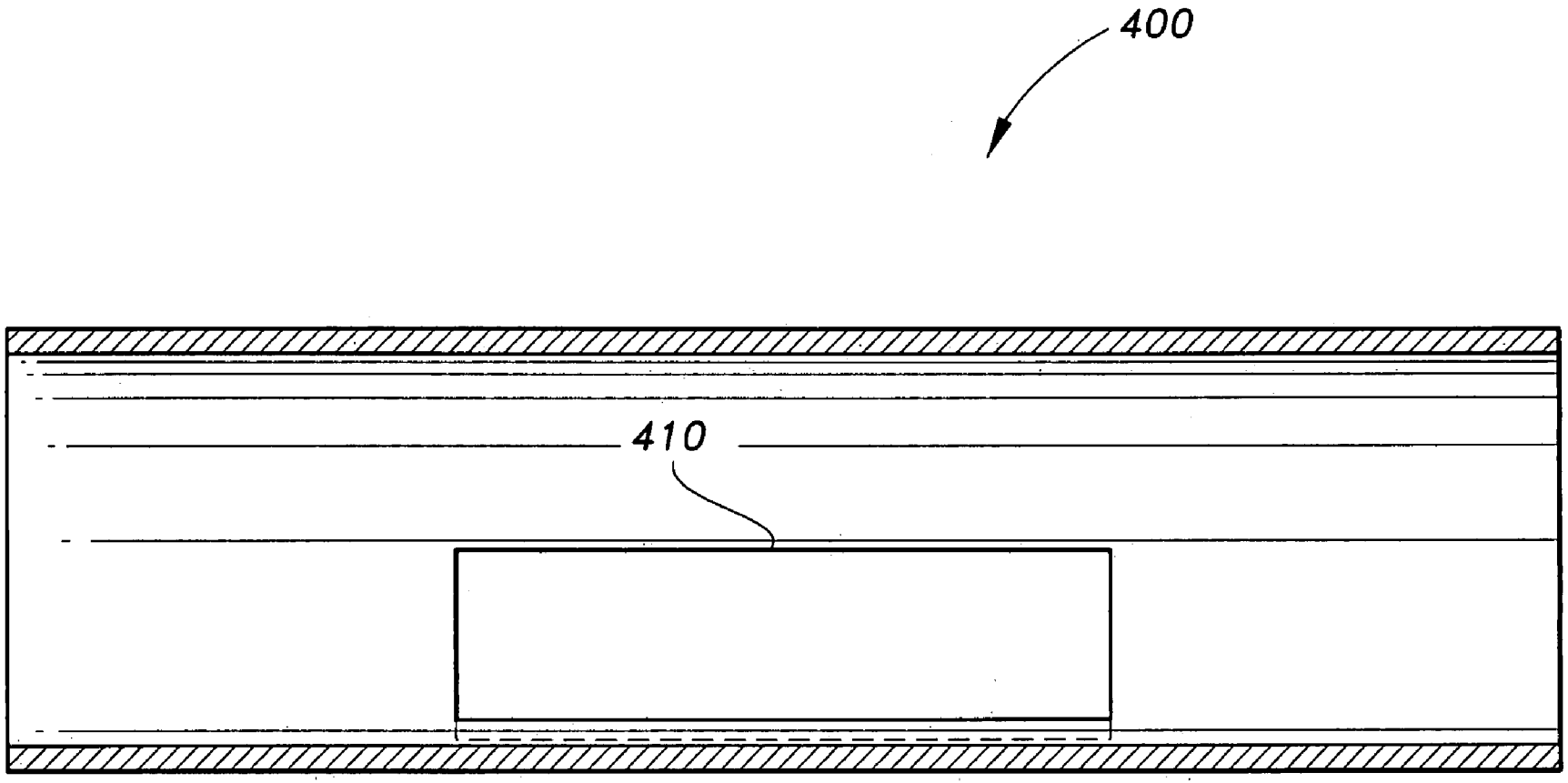
FIG. 5 is a side view of a cylinder of an opposed piston engine according to the present invention.

FIG. 4 illustrates a cross sectional view 300 of a rotating cylinder 310 that shows a spark rod 330 bisecting the cylinder 310 with insulating elements 332. The ground element 334 is on the face of the end cap on the piston. Once the ground element 334 makes contact with the spark rod 330 at top dead center, ignition occurs. A truncated spark plug is shown as 340. A side view of a rotating cylinder 400 is illustrated in FIG. 5. The aperture 410 is defined in the circumferential surface of the rotating cylinder 400.

The inventive opposed piston engine configurations shown in FIGS. 1–5 overcome the problems associated with the prior art by eliminating the most inefficient elements of the internal combustion engine as it is commonly understood. These opposed piston engines do this by utilizing an opposed piston configuration in conjunction with a rotating cylinder driven by gears located on the crankshaft(s). The cylinder has an aperture of about sixty degrees of the outside circumference and equal to two times the lengths of the strokes of one of the cranks plus the thickness of the piston caps. The crankshaft, connecting rod, and piston are of standard design, but are capped with a carbon fiber and/or ceramic cylindrical filler and cap, the cylindrical filler being roughly of a diameter equal to the interior of the cylinder, and the length of the stroke, and the cap, being the diameter of the cylinder, connected to the cylindrical filler, but rotating along with the cylinder. In addition, there is an insulated rod which passes through the center of the cylinder through which the combustion spark is transmitted.

Figure 6:
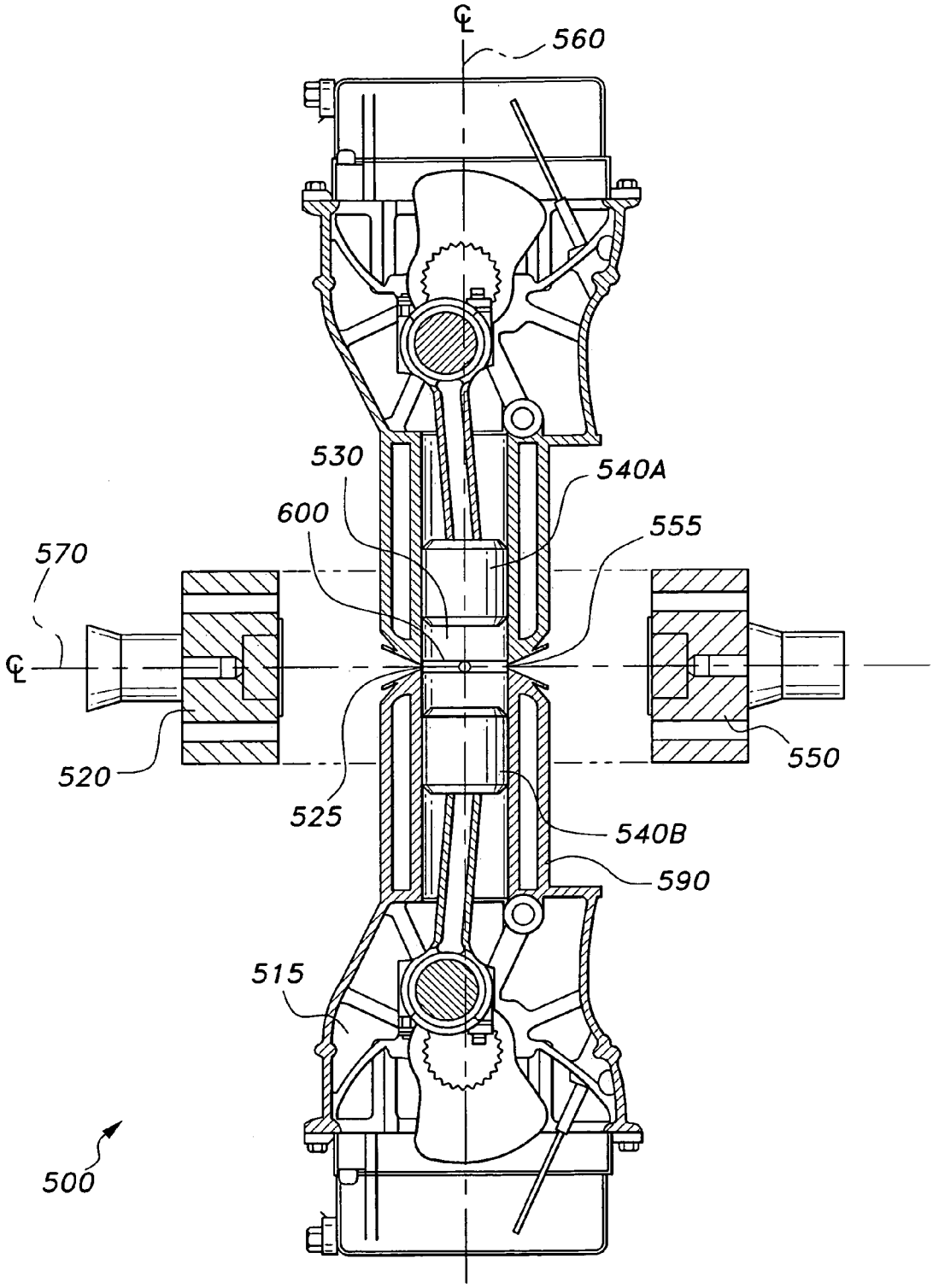
FIG. 6 is a sectional view of an example of an opposed piston engine of the present invention, where the section is through a pair of opposed pistons and a combustion chamber of the engine.

FIG. 6 shows another example of an opposed piston engine 500 according to the present invention. The opposed piston engine 500 includes a valve 600 for the engine 500 shown at a particular position for the opposed piston engine 500. The opposed piston engine 500 includes a first piston 540A, a second piston 540B opposed to the first piston 540A, and the valve 600 which is located between the first and second pistons 540A and 540B. As noted above, the opposed piston engine 500 of the present invention achieves an improvement in fuel efficiency of less than or equal to 30% compared to conventional engines.

Unlike the prior art, the engine 500 of the present invention may be adapted such that the engine 500 does not use, need, and/or require a scavenging valve. Also, the engine 500 of the present invention does not require a conventional head. Further, a combustion chamber 530 of the engine 500 of the present invention is located between the first and second pistons 540A and 540B.

The engine 500 may have a crankcase 515, the combustion chamber 530 described above, and a block 590. The engine may further have an intake 520, and an exhaust 550. The valve 600 has an intake side 525 and an exhaust side 555. Each of the first and second pistons 540A and 540B has a piston face 542 which faces the combustion chamber 530.

An important feature of the opposed piston engine configuration shown in FIG. 1 is the location of the valve 600. The valve 600 may be centered between the first and second pistons 540A and 540B. As such, the combustion chamber 530 may also be centered between the first and second pistons 540A and 540B.

The valve 600 may be any suitable valve for allowing fuel and air to enter and exit the combustion chamber 530. The actuation of the valve 600 is discussed in greater detail below.

The first and second pistons 540A and 540B may reciprocate along a first centerline 560, where the first centerline 560 is perpendicular to a second centerline 570.

The valve 600 may be located at the intersection of the first and second centerlines 560 and 570. Specifically, the center of the valve 600 may be located at the intersection of the first and second centerlines 560 and 570. By locating the valve 600 and the combustion chamber 530 at the intersection of the first and second centerlines 560 and 570 of the engine 500, the engine 500 operates in perfect or near perfect balance, and reduces the deleterious effects of vibration known in conventional engines.

The engine 500 may further comprise an intake 520, and an exhaust 550. The intake 520 and exhaust 550 may be located along or centered on the second centerline 570. The intake 520 and exhaust 550 may be adjacent to the intake side 525 and the exhaust side 55 of the valve 600, respectively. As such, the intake 520 and the exhaust 550 may be located along the second centerline 570 between the first and second pistons 540A and 540B.

Specifically, the location of the entry of air and fuel into the combustion chamber 530 through the valve 600 may be located precisely at the intersection of the second centerline 570 and the valve 600 on the intake side 525 of the valve. Conversely, the location of the exit of exhaust from the combustion chamber 530 through the valve 600 may be located precisely at the intersection of the second centerline 570 and the valve 600 on the exhaust side 555 of the valve. As above, this configuration of the engine 500 is advantageous in that the engine 500 operates in perfect or near perfect balance, and reduces the deleterious effects of vibration known in conventional engines.

Figure 7:
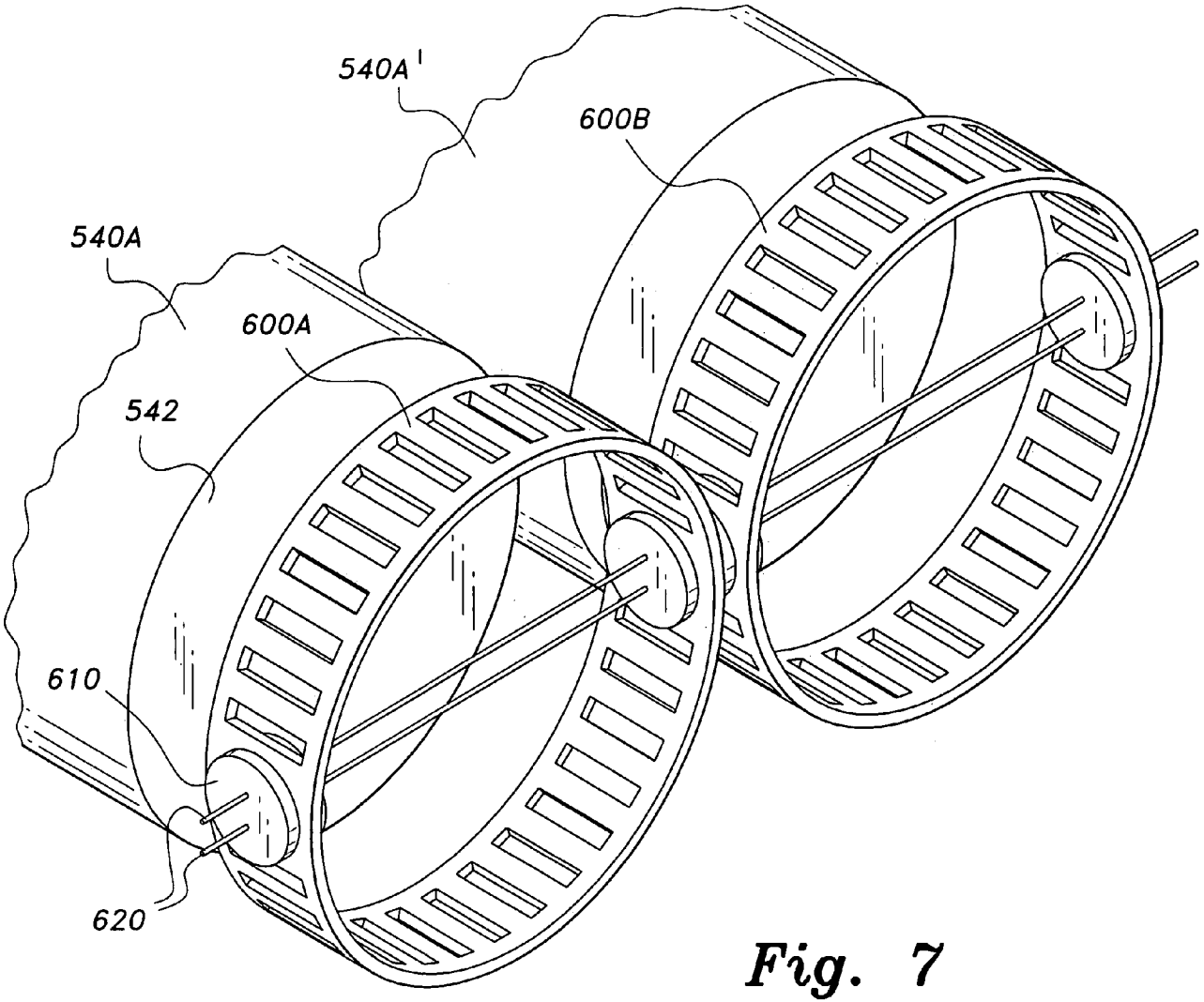
FIG. 7 is a perspective view of examples of first and second valves in relation to examples of first and second upper cylinders of two pair of opposed cylinders in the engine of the present invention. For simplicity, the first and second lower cylinders are not shown.
Figure 8:
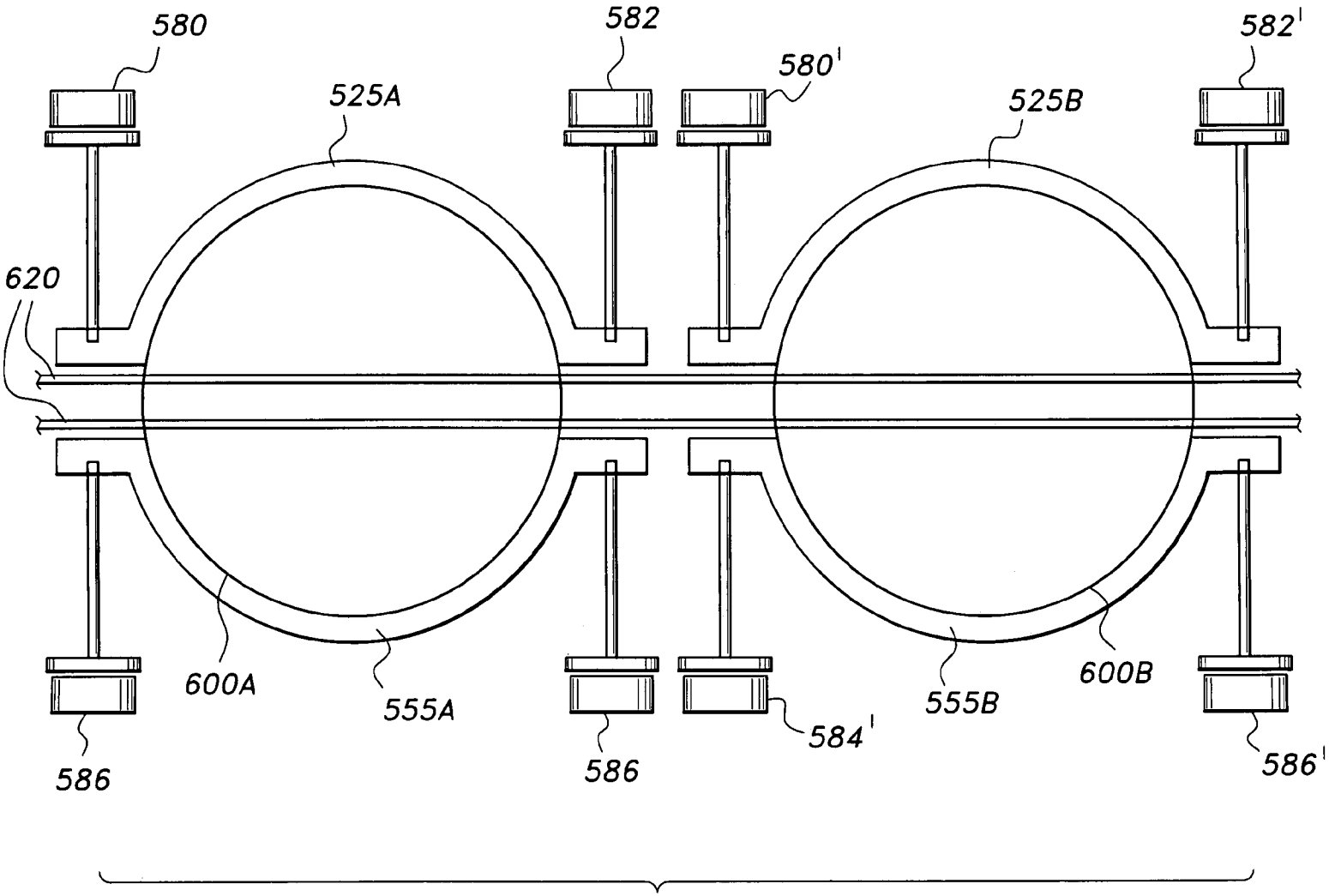
FIG. 8 is a sectional, schematic view of examples of the first and second valves of the engine of the present invention with relation to electromagnets.

As shown in FIGS. 7 and 8, a first valve 600A is adjacent to a second valve 600B, which represents a first pair of opposed cylinders adjacent to a second pair of opposed cylinders in the engine 500. For the sake of simplicity, a first upper cylinder 540A and a second upper cylinder 540A' of the first and second pairs of opposed cylinders are shown. An igniter 620 may pass through each of the first and second valves 600A and 600B in a direction perpendicular to the first centerline 560. The igniter 620 may be any suitable means for igniting the air and fuel mixture in the combustion chamber 530. The igniter 620 may be, for example, a spark rod, a spark plug or the like. If the igniter 620 is a spark rod, the spark rod may be adapted to interact with the piston face 542 at or before top dead center position. The piston face 542, which is a ground, completes the circuit, causes the spark rod to emit a spark, and ignites the fuel in the combustion chamber 530. Alternately, the igniter 620 may comprise a ground element 622 (see FIG. 10). An insulator 610 may be provided in each of the first and second valves 100A and 600B adjacent to the igniter 620.

As seen best in FIG. 7, the valve 600 may have a hollow, generally cylindrical shape or a ring-like shape. Although the valve 600 is shown in a unitary or one-piece construction, it is to be understood that the valve 600 may also be divided into two or more sections which, when assembled, form the hollow, generally cylindrical shape or the ring-like shape shown in FIG. 7.

The valve 600 may be provided in any suitable size as is appropriate for the size of the pistons and combustion chamber of the engine. Also, the valve 600 may be formed as an integral part of the intake 520 and the exhaust 550, and/or the cylinder bore, the block 590, or any other suitable part of the engine 500. On the other hand, the valve 600 may be formed as a part that is then attached to the intake 520 and the exhaust 550, and/or the cylinder bore, the block 590, or any other suitable part of the engine 500.

As seen best in FIGS. 6 and 7, a first length of the valve 600 in a direction parallel to the first centerline 560 is desirably shorter than a second length of the valve 600 in a direction parallel to the second centerline 570. The first length and the second length of the valve 600 may be any suitable size. The valve 600 may be located inside the combustion chamber 530, or the valve 600 may be located outside the combustion chamber 530.

Figure 9:
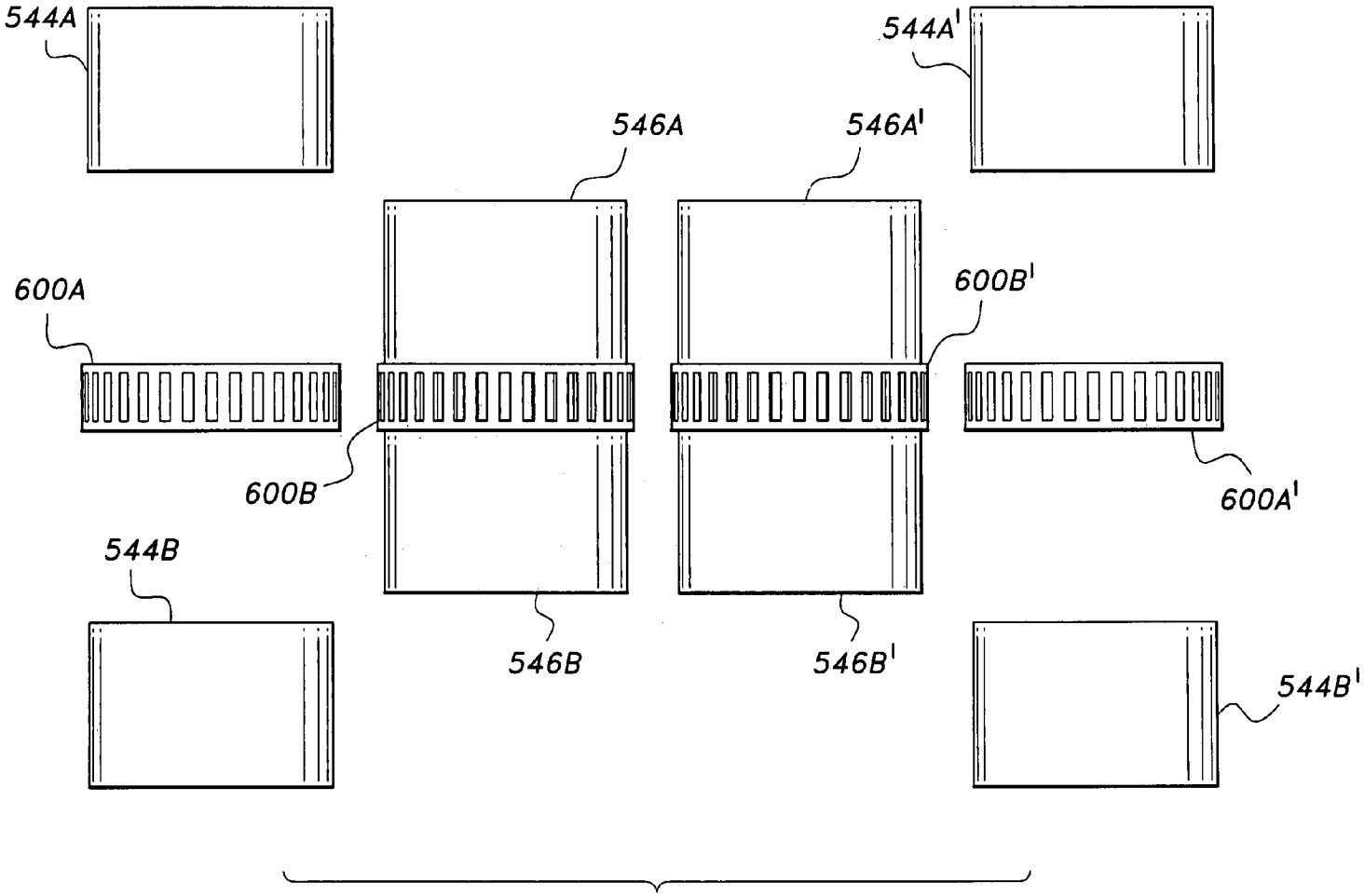
FIG. 9 is a schematic view of examples of first, second, third and fourth valves for first, second, third, and fourth pairs of opposed pistons of the engine of the present invention.

As seen best in FIG. 9, the first length of the valve 600 may be equal to or slightly less than the distance between the opposed pistons when the opposed pistons are in top dead center position, i.e. the opposed pistons 546A, 546B, 546A' and 546B' are shown in top dead center position. Although not shown, the first length of the valve 600 may be greater than the distance between the opposed pistons when the opposed pistons are in top dead center position. The second length of the valve 600 may be greater than, equal to, or less than either the bore of the cylinder or the diameter of the piston.

The valve 600 may be any suitable valve for allowing fuel and air to enter and exit the combustion chamber 530. The valve 600 may, for example, be made of a ceramic material or steel. The valve 600 may be actuated (opened and closed) using any suitable means of actuation.

For example, as shown best in FIG. 7, the valve 600 may have one or more openings or perforations. The openings may be any suitable shape, size and number and in any suitable configuration. The openings may be of the same or different sizes. The openings may be spaced apart equally or with differing length spaces between the openings.

The valve 700 may be adapted to be opened and closed by moving the valve 700 parallel to the first centerline 560, or by rotating the valve 600 about the first centerline 560, thus aligning and un-aligning the openings with the intake 520 and/or the exhaust 550 of the engine 500 as the cycle of the engine warrants. In operation, the valve 600 may be adapted to rotate about the first centerline 560 in one direction or in two directions (back and forth).

Alternately, for example, the valve 600 may be adapted to be opened and closed by the use of flaps (not shown) which open and close. The flaps may, for example, be opened and closed using electromagnetic actuation.

The valve 600 itself may, for example, be actuated using electromagnetic actuation (see below), a gear driven system (see FIGS. 11 and 12), or a cam and pushrod system (not shown).

As seen in FIG. 8, each of the first and second valves 600A and 600B may be adapted to be opened and closed by electromagnetic actuation. Specifically, a first electromagnet 580 may be adapted to open the first valve 600A on a first intake side 525A, a second electromagnet 582 may be adapted to close the first valve 600A on the first intake side 525A, a third electromagnet 584 may be adapted to open the second valve 600A on a first exhaust side 555A, and a fourth electromagnet 586 may be adapted to close the second valve 600A on the first exhaust side 555A. In a manner similar to that described above, electromagnets 580', 582', 584', and 586' may be adapted to open and close the second valve 600B on second intake and exhaust sides 525B, 555B.

In the opposed piston example shown in FIGS. 6, 7, and 8, the engine 500 is provided with an electro-magnetically actuated valve 600. When current is applied to the first electromagnet 580, the valve 600 is opened allowing air and fuel to enter the intake 520 and the combustion chamber 530. Next, the second electromagnet 582 receives current and closes the valve 600 from the intake 520. The air and fuel are compressed and then ignited by the igniter 620 thus creating a power cycle of the engine 500.

At the beginning of an exhaust cycle of the engine 500, current is sent into the third electromagnet 584 that opens the valve 600 and exhaust gases are allowed to pass into the exhaust 550. At the end of the exhaust stroke, the fourth electromagnet 586 receives power thus closing the valve 600.

As shown in FIGS. 8 and 9, the engine 500 may be a four-stroke engine, also known as a four-cycle engine.

The four-stroke engine may comprise a first pair of opposed pistons 544A, 544B, a first valve 600A between the first pair of opposed pistons 544A and 544B, a first intake side 525A of the first valve 600A, a first exhaust side 555A of the first valve 600A, a second pair of opposed pistons 546A and 546B adjacent to the first pair of opposed pistons 544A and 544B, a second valve 600B between the second pair of opposed pistons 546A and 546B, a second intake side 525B of the second valve 600B, and a second exhaust side 555B of the second valve 600B. As an example, the left side of FIG. 9 shows first and second pairs of opposed pistons 544A, 544B, 546A, and 546B, and the right side of FIG. 9 shows third and fourth pairs of opposed pistons 544A', 544B', 546A', and 546B', thus forming an eight-cylinder opposed piston engine.

For example, as seen in FIG. 9, the first pair of opposed pistons 544A and 544B may be adapted to be at a bottom dead center position with the first valve 600A closed when the second pair of opposed pistons 546A and 546B is at a top dead center position with the second valve 600B open or vice-versa.

In the present case, vice-versa means the first pair of opposed pistons 544A and 544B may be adapted to be at a top dead center position with the first valve 600A open when the second pair of opposed pistons 546A and 546B is at a bottom dead center position with the second valve 600B closed.

Similarly, the fourth pair of opposed pistons 544A' and 544B' may be adapted to be at a bottom dead center position with the first valve 600A' closed when the second pair of opposed pistons 546A' and 546B' is at a top dead center position with the second valve 600B' open or vice-versa.

Although FIG. 9 shows that the first and fourth pairs of opposed pistons 544A, 544B, 544A', and 544B' are aligned, and that the second and third pairs of opposed pistons 546A, 546B, 546A', and 546B' are aligned, it is to be understood that any suitable firing and timing arrangement of the pairs of opposed pistons may be provided.

Figure 10:
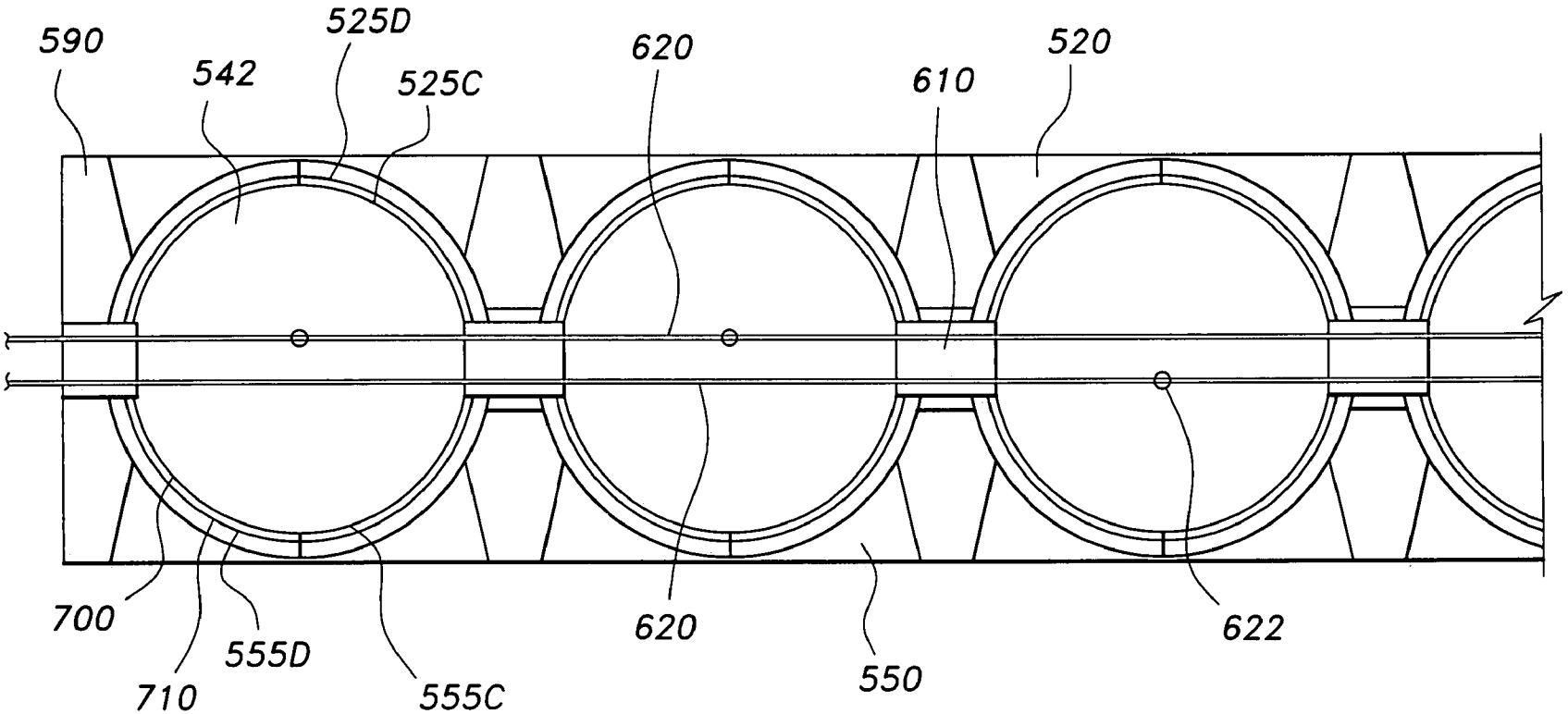
FIG. 10 is a sectional view of examples of several sets of inner and outer valves for several pairs of opposed pistons of an assembled engine of the present invention.

As shown in FIG. 10, the valve 600 may comprise an inner valve 700 and an outer valve 710, where the inner valve 700 is adapted to fit inside the outer valve 210. The inner valve 700 has an intake side 525C and an exhaust side 555C, and the outer valve 710 has an intake side 525D and an exhaust side 555D. The inner and outer valves 700 and 710 may act cooperatively to open and close the space either between the intake 520 and the combustion chamber 530 or between the combustion chamber 530 and the exhaust 550. One of the inner valve 700 or the outer valve 710 may be adapted to be fixed while the other moves. Alternately, both the inner valve 700 and the outer valve 710 may be adapted to move or both may be fixed.

Either the inner valve 700 or the outer valve 710 may be adapted to move parallel to the first centerline 560. Either the inner valve 700 or the outer valve 710 may be adapted to be opened and closed by rotating about the first centerline 560. Either the inner valve 700 or the outer valve 710 may be adapted to be opened and closed by electromagnetic actuation.

Figure 11:
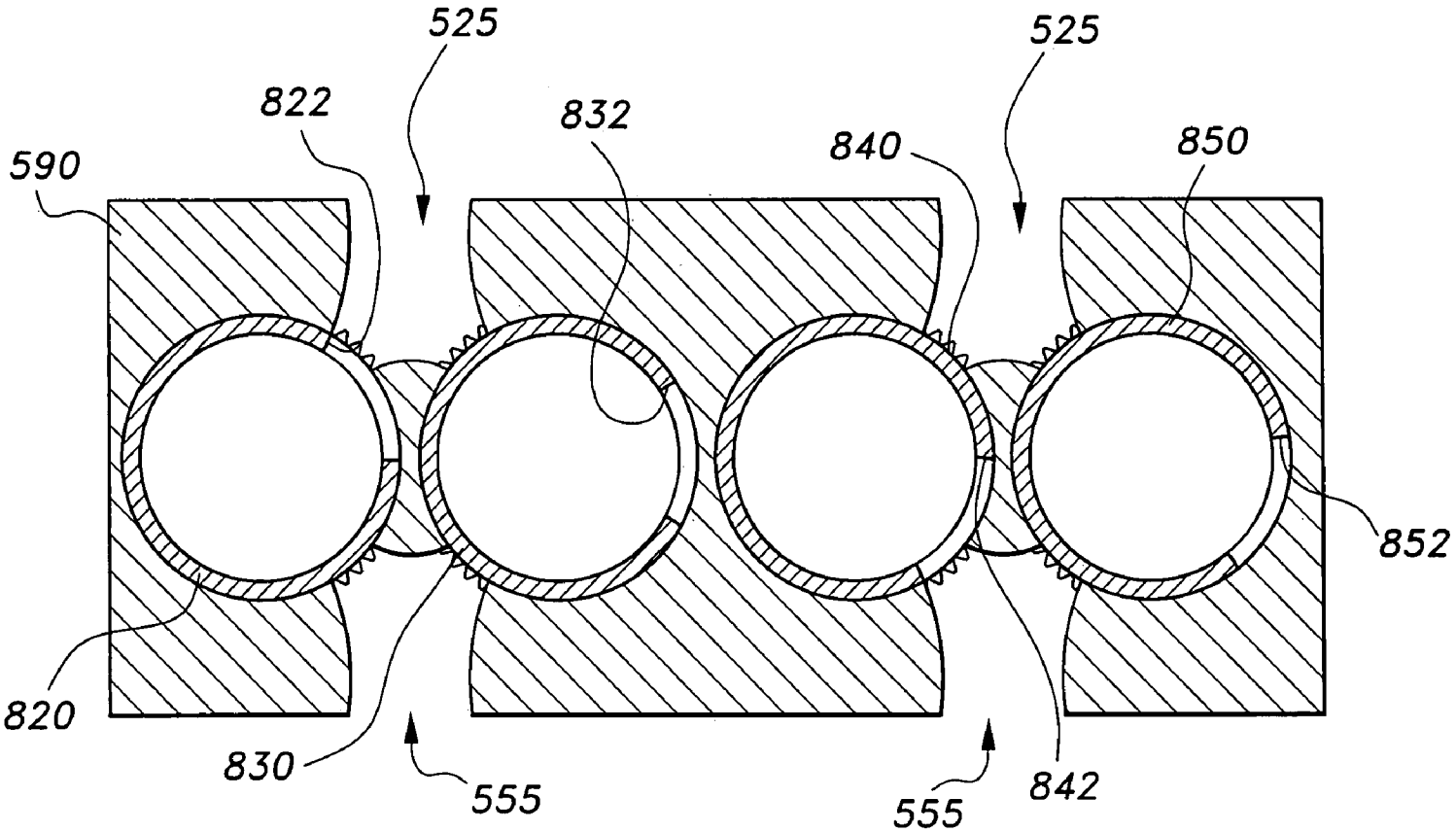
FIG. 11 is a sectional view of examples of first, second, third and fourth valves of the present invention.
Figure 12:
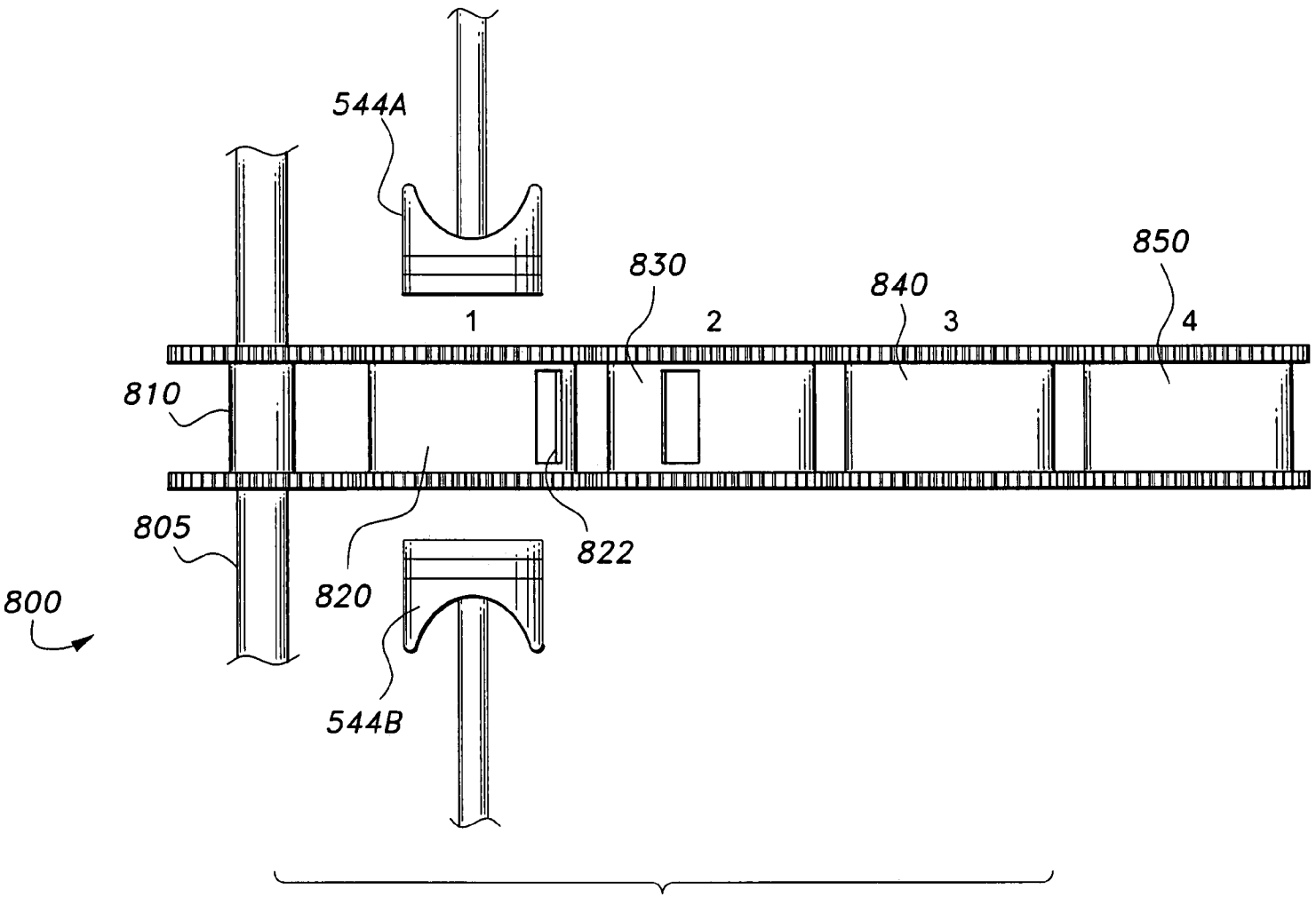
FIG. 12 is a side view of examples of first, second, third, and fourth valves of the present invention.

Another example of an opposed piston engine according to the present invention is shown in FIGS. 11 and 12. In this configuration, a driving shaft drives a driving device which is in a geared relationship with a first valve 820. The first valve 820 is adapted to be in a geared relationship with a second valve 830, the second valve 830 with a third valve 840, and the third valve 830 with a fourth valve 850.

The driving shaft may be provided parallel to the first centerline 560. The driving device may comprise a pair of toothed gears at either end of the device. Likewise, the each of the valves 820, 830, 840 and 850 may comprise a pair of toothed gears at either end. The toothed gears may be circular with an axis that is parallel to the first centerline 560 and the toothed gears may be adapted to rotate in a plane which is parallel to the second centerline 570.

In operation, the driving device 810 may be adapted to rotate in a first direction, which causes the first valve 820 and the third valve 840 to rotate in a second direction opposite the first direction, and which causes the second valve 830 and the fourth valve 850 to rotate in the first direction.

The valves 820, 830, 840, and 850 each include an aperture 822, 832, 842, and 852, respectively, which may be adapted to rotate into any suitable position during the combustion cycle. For example, as shown in FIG. 11, the aperture 822 of first valve 820 may align with the intake 520 while the aperture 842 of the third valve 840 is aligned with the exhaust 550. Also, in this case, the opposed pistons associated with the second valve 830 are in the compression stroke while the opposed pistons associated with the fourth valve 850 are in the power stroke. In other words, the engine 500 is configured to operate as a four-stroke engine.

The apertures 822, 832, 842, and 852 may be provided in any suitable shape or size. Although FIGS. 11 and 12 present the apertures as generally rectangular, any suitable shape may be used. Also, for example, the apertures 822, 832, 842, and 852 may have a size which comprises between 0° and 90° of the full 360° circumference of the valve, preferably between 30° and 70°, and even more preferably about 60°, although any suitable size may be used.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A four cycle opposed piston engine comprising:

a rotating cylinder with a surface circumference and an aperture defined through the surface circumference; and first and second opposing pistons each having a forward end, said pistons being positioned within the cylinder;

first and second opposing cylindrical spacers proximate the forward end of the respective first and second piston; and first and second opposing piston caps proximate the respective first and second spacer, each spacer being positioned between an associated piston and piston cap.

2. The four cycle opposed piston engine according to claim 1, wherein said aperture has a size between 30° and 70° of said circumference.

3. The four cycle opposed piston engine according to claim 2, wherein said aperture has a size of about 60° of said circumference.

4. The four cycle opposed piston engine according to claim 1, wherein said first and second opposing piston caps each have a face and a grounding element centrally positioned on the face of the associated piston cap.

5. The four cycle opposed piston engine according to claim 1, wherein said first and second opposing cylindrical spacers, and first and second opposing piston caps are made of carbon fiber.

6. The four cycle opposed piston engine according to claim 1, wherein said first and second opposing cylindrical spacers, and first and second opposing piston caps are made of ceramic.

7. The four cycle opposed piston engine according to claim 1, wherein said engine further comprises:

a spark rod passing through a center of the cylinder.

8. The four cycle opposed piston engine according to claim 7, wherein said spark rod bisects the cylinder with insulating elements.

9. The four cycle opposed piston engine according to claim 8, further comprising a connecting rod interconnected with each of said first and second pistons.

10. The four cycle opposed piston engine according to claim 1, further comprising a pair of opposing gears at ends of the cylinder.

11. An opposed piston engine method comprising:

providing an engine assembly with a rotating cylinder and first and second opposing pistons each having a forward end, said pistons being positioned within the cylinder;

performing induction, compression, ignition, and exhaust cycles with the engine assembly; and providing the engine assembly with first and second opposing cylindrical spacers, and first and second opposing piston caps, said first and second opposing cylindrical spacers being proximate the forward end of the respective first and second piston, said first and second opposing piston caps being proximate the respective first and second spacer, each spacer being positioned between an associated piston and piston cap.

12. The opposed piston engine method according to claim 11, further comprising:

providing the rotating cylinder with a circumference and an aperture defined through the circumference.

13. The opposed piston engine method according to claim 11, further comprising:

providing the first and second opposing piston caps each with a face and a grounding element centrally positioned on the face of the associated cap.

14. The opposed piston engine method according to claim 11, further comprising forming the first and second opposing cylindrical spacers, and first and second opposing piston caps are made of carbon fiber.

15. The opposed piston engine method according to claim 11, further comprising providing the engine assembly with a spark rod passing through a center of the cylinder.

16. The opposed piston engine method according to claim 11, further comprising providing the engine assembly with a pair of opposing gears at ends of the cylinder.

* * * * *